US007614249B2

(12) United States Patent
Hu

(10) Patent No.: US 7,614,249 B2
(45) Date of Patent: Nov. 10, 2009

(54) MULTI-RANGE CROSS DEFROSTING HEAT PUMP SYSTEM AND HUMIDITY CONTROL SYSTEM

(76) Inventor: Lung Tan Hu, 25755 48th Avenue, Aldergrove, BC (CA) V4W 1J6

( * ) Notice: Subject to any disclaimer, the term of this patent is extended or adjusted under 35 U.S.C. 154(b) by 278 days.

(21) Appl. No.: 11/311,085

(22) Filed: Dec. 20, 2005

(65) Prior Publication Data

US 2007/0137238 A1 Jun. 21, 2007

(51) Int. Cl.
*F25B 13/00* (2006.01)

(52) U.S. Cl. ..... 62/324.1; 62/324.6

(58) Field of Classification Search ..... 62/324.1, 62/324.5, 324.6, 199–200, 277–278
See application file for complete search history.

(56) References Cited

U.S. PATENT DOCUMENTS 2,960,840 A * 11/1960 Hosken et al. ..... 62/81
3,150,498 A * 9/1964 Blake ..... 62/81
4,691,527 A * 9/1987 Ikeda ..... 62/234
5,150,582 A * 9/1992 Gotou ..... 62/155
5,228,301 A * 7/1993 Sjoholm et al. ..... 62/84
5,465,591 A * 11/1995 Cur et al. ..... 62/439
6,276,158 B1 * 8/2001 Lowes et al. ..... 62/324.5
7,171,817 B2 * 2/2007 Birgen ..... 62/81
7,213,407 B2 * 5/2007 Hu ..... 62/324.5

* cited by examiner

*Primary Examiner*—William E Tapolcai

(57) ABSTRACT

The present invention provides an air-condition heat pump system and two-stage defrosting control method for continuous operation under an environment temperature range from 20 degree to negative 40 degree Celsius or lower. The heat pump system employs different defrosting methods under different temperature and humidity conditions. A ventilation and humidity control system is also provided for implementing the cross defrosting heat pump system within an indoor dimension.

20 Claims, 10 Drawing Sheets

MULTI-RANGE CROSS DEFROSTING HEAT PUMP SYSTEM AND HUMIDITY CONTROL SYSTEM

FIELD OF THE INVENTION

The present invention relates to a multi-range air-condition heat pump, more particularly to a multi-range air-condition heat pump capable of uninterrupted operation. The present invention can be applied on residential, agriculture, commercial transportation, and industrial purposes. More particularly, the present invention can be used for air-conditioning, refrigeration.

BACKGROUND OF THE INVENTION

Current available heat pump requires different types of compressors for different range of working environment temperature; therefore, the user may need to install multiple air-conditioning systems such as a combination of a heat pump and a gas heater for different range of working temperature. One of the reasons is the low efficiency of the heat pump under low working temperature; another reason is the need for interrupting operation due to the frost conditions on evaporators.

The current defrosting methods such as electrical defrost system and reverse-circulation defrost system require the heat pump to stop operation while defrosting. Therefore, it is one objective of the present invention to provide an air-condition heat pump capable of uninterrupted operation during system defrosting process.

Another objective of the present invention is to provide the most efficient control methods for cross defrosting heat pump system under different temperature and humidity conditions; most heat pumps require the heat energy from other source to maintain the heating efficiency while the present invention defrosts with the heat energy absorbed from the environment and the heat energy generated by the compressor.

Current compressors have very low efficiency under low temperature range, the current two-stage compressors utilize two compression strokes to increase system efficiency, however, the current two-stage compressors can not operate under different temperature range, in other words, the two-stage compressor can not operate under the environment that does not require pressure boosting; therefore it is another objective of the present invention to provide a multi-stage pressure boosting heat pump system capable of adjusting the level of pressure boosting in order to operate under a wide range of working environment temperature.

Current ventilation and humidity control systems can not fully utilize the heat energy in the indoor air exhaust; therefore it is yet another objective to provide a ventilation and humidity control system to combine with the multi-range cross defrosting heat pump systems of the present invention. The ventilation and humidity control system recycles the heat energy from the indoor exhaust and adjusts the ventilation rate according to the humidity percentage. For the human comfort in most indoor space, the ventilation rate required is directly proportional to the humidity percentage, the ventilation and humidity control system of the present invention raises the ventilation rate by automatically adjusting the defrosting duration, since the multi-range cross defrosting heat pump system of the present invention requires more defrosting time when the humidity percentage of the working environment is high.

In general, current heat pump system has very limited range of working temperatures due to the limitation and the operation efficiency of the compressor; however, in many circumstances, the environment temperature may vary from negative 40 degree to 20 degree Celsius, therefore it is main objective of the present invention to provide a multi-range cross defrosting heat pump capable of operating under a wide range of working environment temperature at high efficiency.

SUMMARY OF THE INVENTION

1. It is a primary object of the present invention to provide a multi-range cross defrosting heat pump system capable of operating under various range of temperature.

2. It is a second object of the present invention to provide a multi-range cross defrosting heat pump system capable of uninterrupted continuous operation during defrosting process.

3. It is another object of the present invention to provide the most efficient defrosting control method for the multi-range cross defrosting heat pump system which is capable of defrosting with the heat energy absorbed from the environment and the heat energy generated from the compressor, therefore minimizing the energy required for defrosting process.

4. It is yet another object of the present invention to provide a ventilation and humidity control system that can combine and fully utilize the multi-range cross defrosting heat pump of the present invention.

BRIEF DESCRIPTION OF THE DRAWINGS

FIG. 1A is an operation scheme of the first embodiment, in which all the evaporators are evaporating the refrigerant therein.

FIG. 1B and FIG. 1C are the operation schemes of the first defrosting method, which is also called as the cross-air defrosting process.

FIG. 1D and FIG. 1E are the operation schemes of the second defrosting method, which is also called as the high speed cross reverse defrosting process.

FIG. 2A is an operation scheme of the second embodiment, in which all the evaporators are evaporating the refrigerant therein.

FIG. 2B and FIG. 2C are the operation schemes of the first defrosting method, which is also called as the cross-air defrosting process.

FIG. 2D and FIG. 2E are the operation schemes of the second defrosting method, which is also called as the high speed cross defrosting process.

DESCRIPTION OF THE PREFERRED EMBODIMENTS

The present invention includes two main embodiments, the first embodiment is the multi-range cross-defrosting humidity control system constructed with the cross reverse refrigerant circulation, the second embodiment is the multi-range cross-defrosting humidity control system constructed with the one-body defrost condenser.

Now referring to FIG. 1A to FIG. 1E and Table 1 for the first embodiment:

The basic operation scheme is shown in FIG. 1A to FIG. 1E, the multi-range cross-defrosting humidity control system operates with a control system that change the defrosting methods according to the outdoor temperature and humidity; when the outdoor temperature is in the range of 20 degree Celsius to 0 degree Celsius, the control system can apply the first defrosting method, which is also called as the cross-air defrosting process; when the outdoor temperature is in the range of 10 degree to negative 40 degree or lower, the control system can apply the second defrosting method, which is also called as the high speed cross-reverse defrosting process; the threshold at which the control system switch between the first defrosting method and the second defrosting method can be adjust at any point between 10 degree Celsius to 0 degree Celsius; for the ease of comprehension, the threshold will be set as 5 degree Celsius, it should be understood that this threshold value should be adjusted according to the heating need and the humidity of the outdoor environment for the best heating efficiency and the indoor humidity control.

Figure 1A:
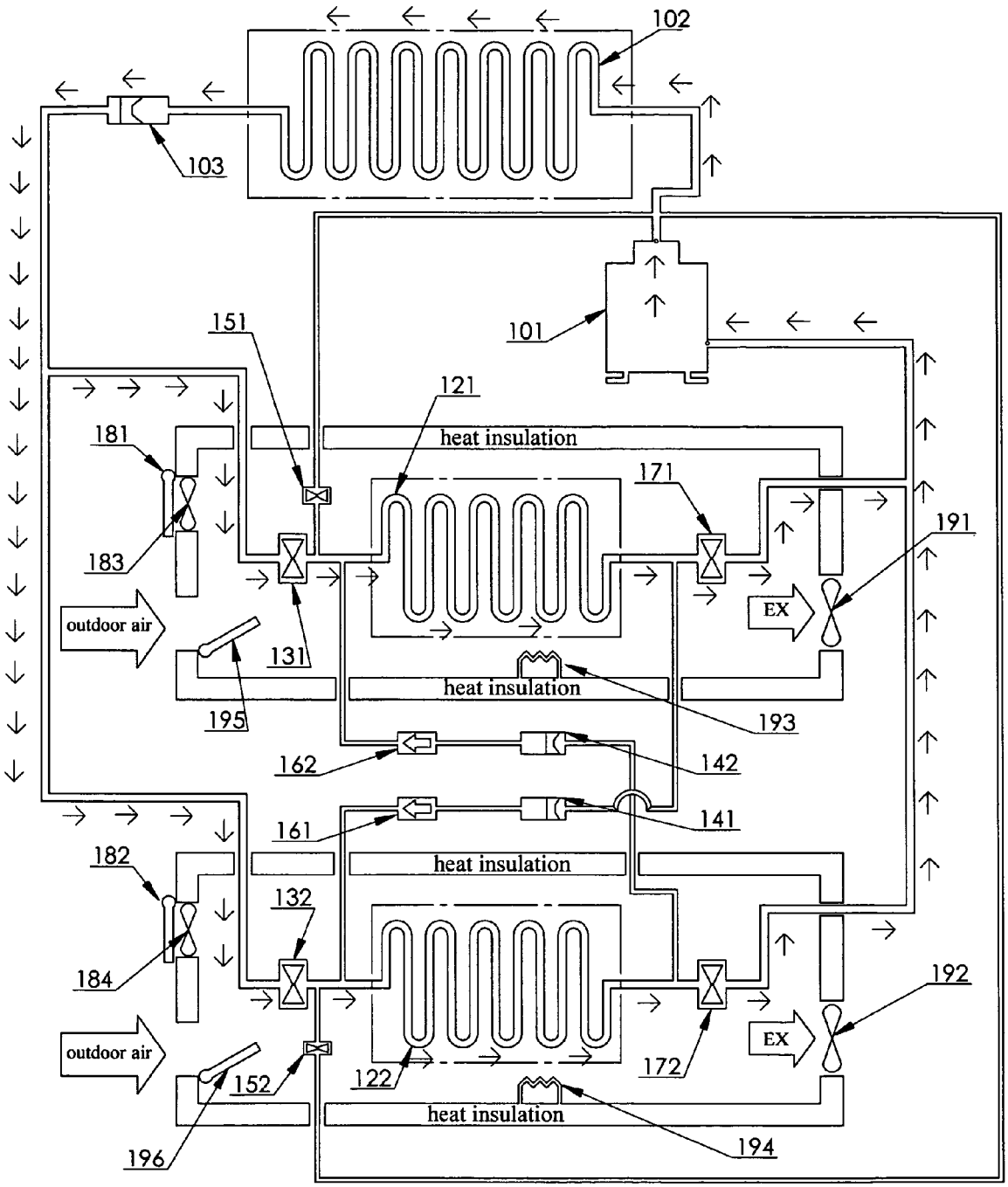
FIG. 1A to FIG. 1E shows the first embodiment of the present invention, which is the multi-range cross-defrosting humidity control system constructed of the cross-reverse refrigerant circulation; the control logic table is provided in Table. 1 as a reference to FIG. 1A to FIG. 1E.

As shown in FIG. 1A, the cross reverse defrosting humidity control system comprising the following basic components: main compressor 101, main condenser 102, first evaporator 121, second evaporator 122, main expansion valve 103, first upper-flow valve 131, second upper-flow valve 132, first lower-flow valve 171, second lower-flow valve 172, first reverse-flow valve 151, second reverse-flow valve 152, first expansion valve 141, second expansion valve 142, first one-way valve 161, second one-way valve 162, first venting fan 191, second venting fan 192, separate heat insulation for each evaporator, first indoor-air-intake fan 181, second indoor-air-intake fan 182, first outdoor-air-intake valve 195, second outdoor-air-intake valve 196, first indoor-air-intake valve 181, second indoor-air-intake valve 182, first temperature sensor 193, second temperature sensor 194, outdoor temperature sensor (not shown).

Figure 1B:
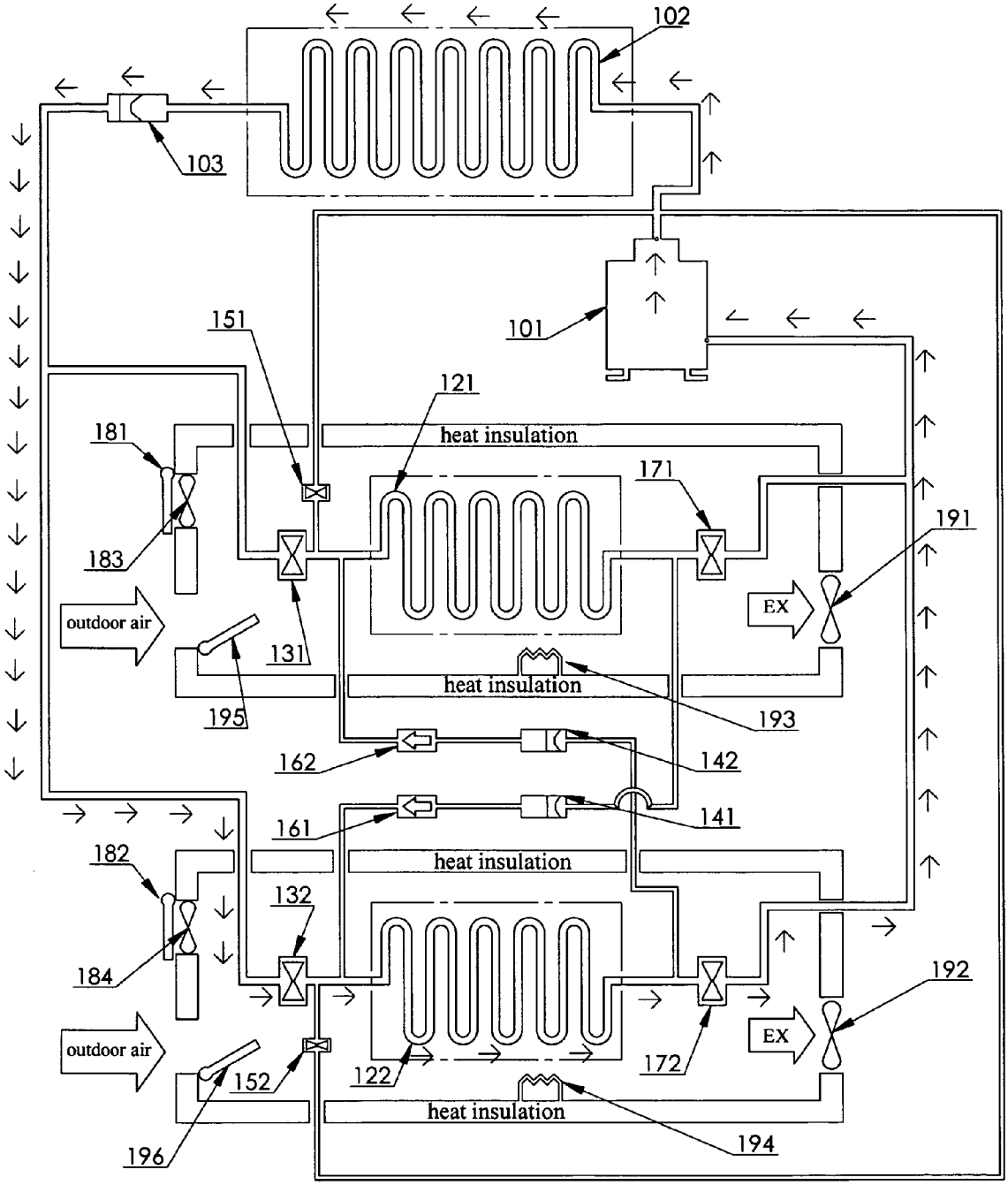
Figure 1C:
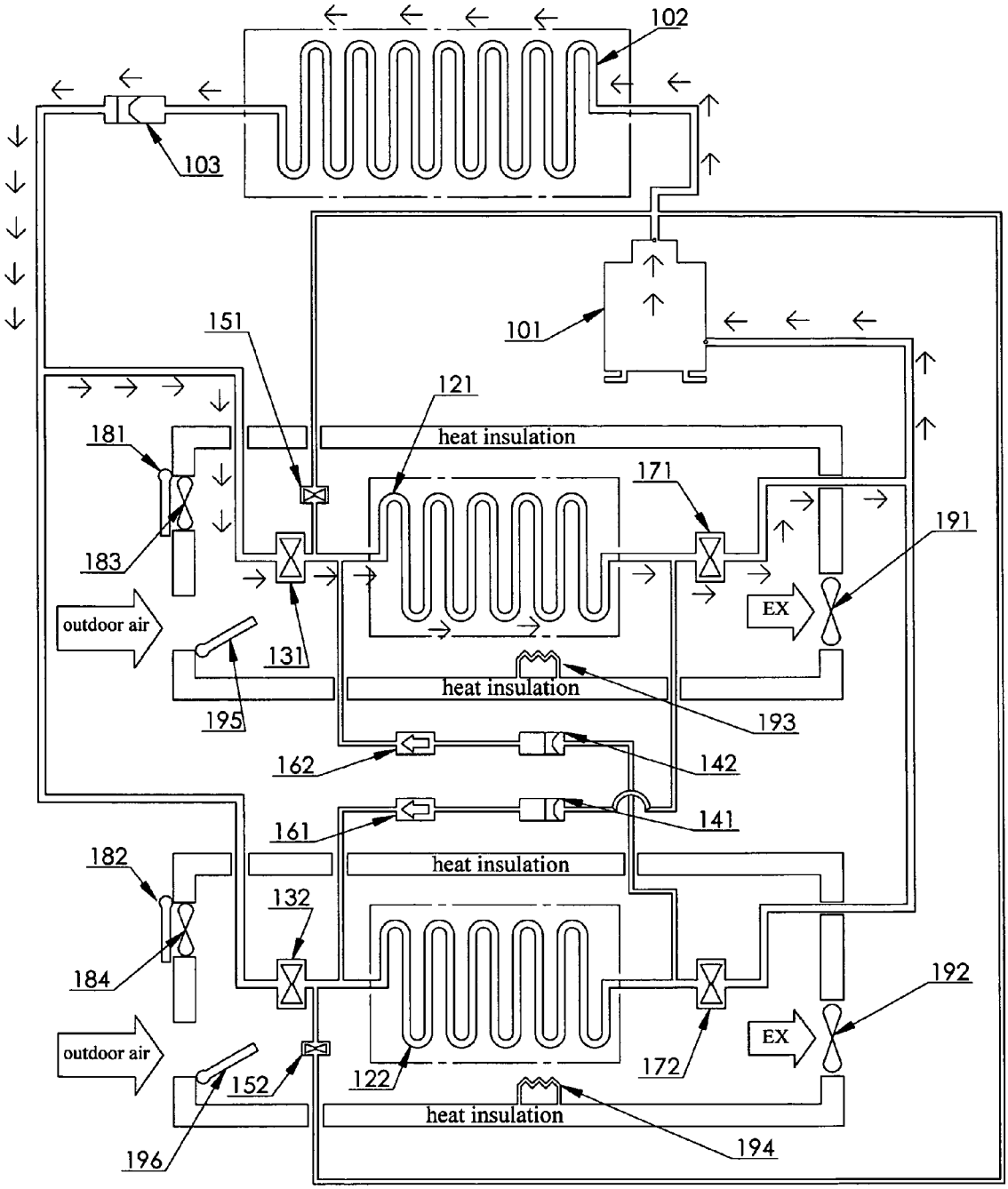

The basic concept of the cross-air defrosting process is to block the refrigerant-flow of the frosted evaporator, and a controlled amount of the outdoor air will flow through that frosted evaporator to heat up the frost thereon, while the other evaporator will operate with the evaporation process to provide the evaporated refrigerant to the main compressor 101 for the pressurization process, the main condenser 102 will carry on the condensation process for the air-conditioning; the cross-air defrosting process requires a defrost-cycle of alternating operation, a defrost cycle is provided as follows, the first evaporator 121 defrosts with cross-air defrosting process for 5 minute as in FIG. 1B, and next the second evaporator 122 defrosts with the cross-air defrosting process for 5 minute as in FIG. 1C, and next the first evaporator 121 and the second evaporator 122 all resume the evaporation process for 10 minute as in FIG. 1A, and next the control system repeats the defrost cycle or switch to another defrosting method if a change in the outdoor temperature is detected.

Now referring to FIG. 1A, in which the first evaporator 121 and the second evaporator 122 are absorbing the heat from the outdoor-air-flow with the evaporation process; the cross reverse refrigerant circulation is disabled by shutting the first reverse-flow valve 151 and the second reverse-flow valve 152; now the refrigerant is circulating as follows, the refrigerant is pressurized in the main compressor 101 and condensed in the main condenser 102, and next the first evaporator 121 and the second evaporator 122 will be evaporating refrigerant to provide the evaporated refrigerant to the main compressor 101; the first indoor-air-intake fan 181 and the second indoor-air-intake fan 182 are stopped to disable the indoor-air-flows of the first evaporator 121 and the second evaporator 122; the first outdoor-air-intake valve 131 and the second outdoor-air-intake valve 132 are open to admit the outdoor-air-flow into the first evaporator 121 and the second evaporator 122.

Now referring to FIG. 1B and FIG. 1C for the first defrosting method of the cross reverse defrosting humidity control system, said first defrosting method is also called as the cross-air defrosting process; the control system can employ said cross-air defrosting process when the outdoor temperature is between 20 degree Celsius and 0 degree Celsius; during the defrost-cycle of the cross-air defrosting process, the control system will defrost each evaporator with a defrost cycle as follows; the first evaporator 121 defrosts with the cross-air defrosting process for 5 minute as shown in FIG. 1B, and next the second evaporator 122 defrosts with the cross-air defrosting process for 5 minute as shown in FIG. 1C, and next the first evaporator 121 and the second evaporator 122 will resume the evaporation process as shown in FIG. 1A or repeat the defrost-cycle if the condition required.

As shown in FIG. 1B is the cross-air defrosting process of the first evaporator 121; the refrigerant-flow of the first evaporator 121 is disabled by shutting the first upper-flow valve 131 and first lower-flow valve 171, the first venting fan 191 will operate at full speed to draw the outdoor air through the first evaporator 121 to melt the frost thereon; the second evaporator 122 will operate with the evaporation process to provide a sufficient flow of evaporated refrigerant to the main compressor 101, the main condenser 102 will continue to generate the heat energy required for the air-conditioning.

As shown in FIG. 1C is the cross-air defrosting process of the second evaporator 122; the refrigerant-flow of the second evaporator 122 is disabled by shutting the second upper-flow valve 132 and the second lower-flow valve 172, the second venting fan 192 will operate at full speed to draw the outdoor air through the second evaporator 122 to melt the frost thereon; the first evaporator 121 will operate with the evaporation process to provide a sufficient flow of evaporated refrigerant to the main compressor 101, the main condenser 102 will continue to generate the heat energy required for the air-conditioning.

Figure 1D:
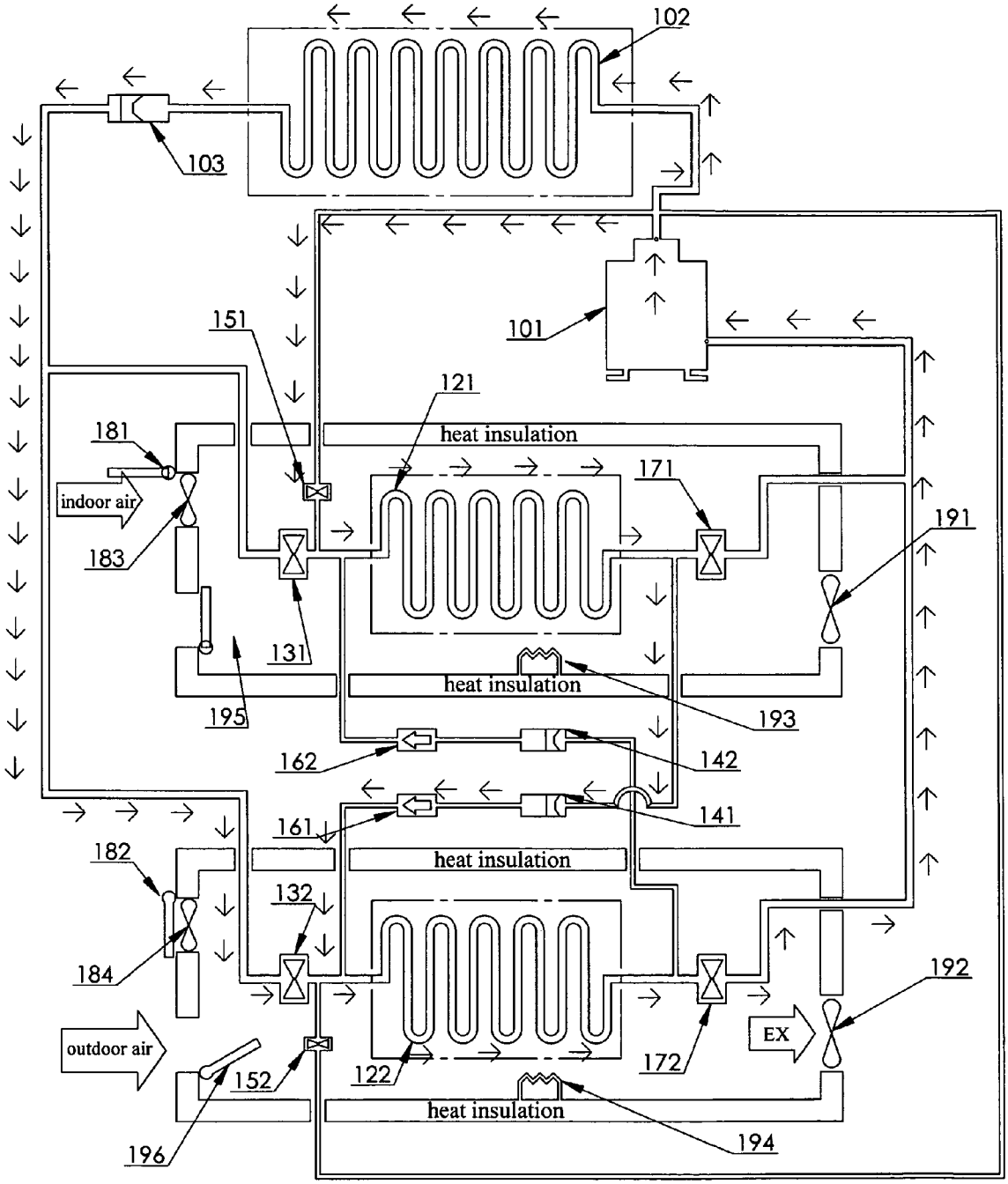
Figure 1E:
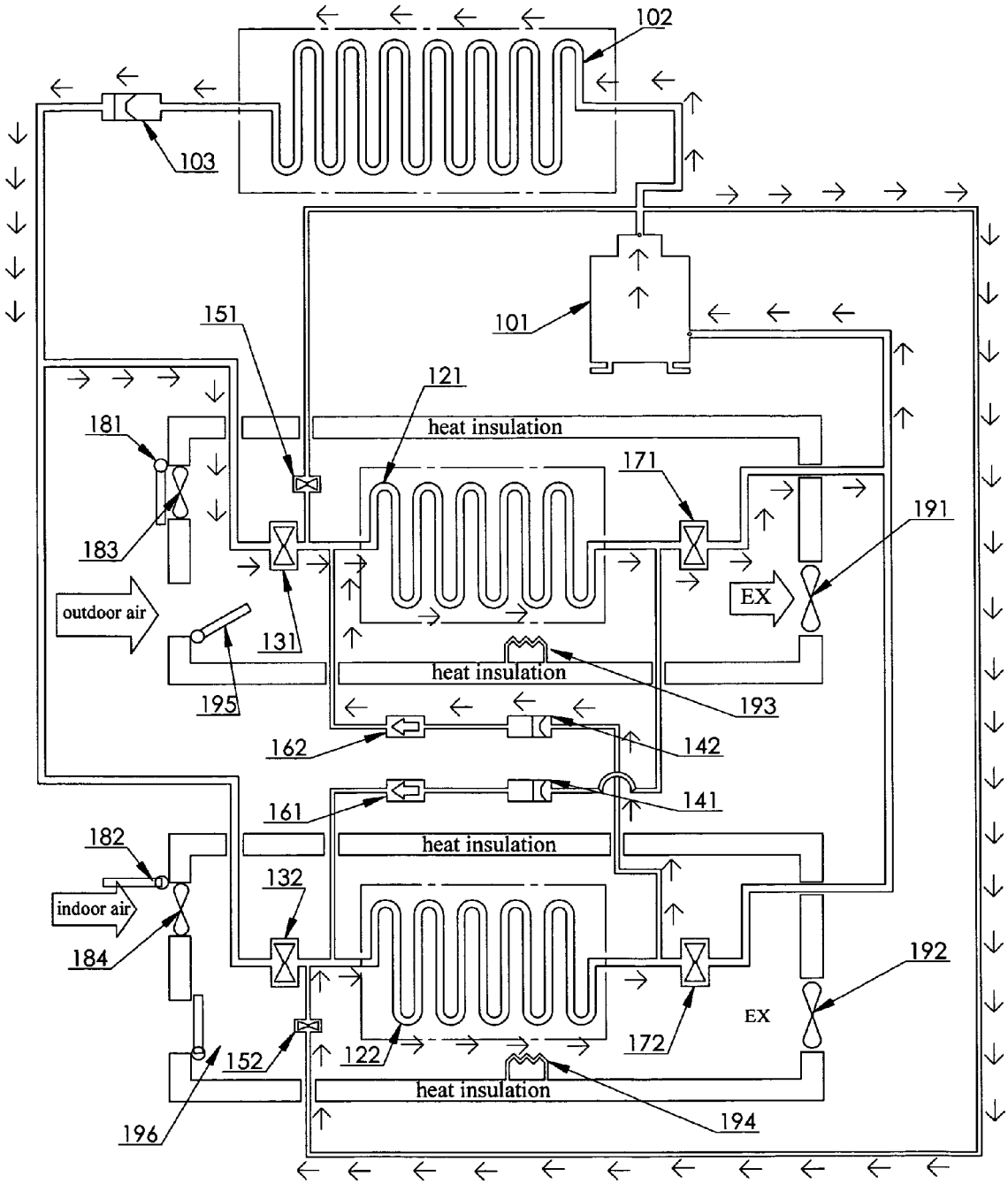

Now referring to FIG. 1D and FIG. 1E. When the outdoor temperature reaches the threshold, at which the cross-air defrosting method cannot provide enough heat energy with the outdoor air, the control system can switch to the second defrosting method as shown in FIG. 1D and FIG. 1E, and said second defrosting method is also called as the high speed cross reverse defrosting process, the applicable range of the high speed cross reverse defrosting process is from 10 degree Celsius to negative 40 degree Celsius and lower; the high speed cross reverse defrosting process also operates in a similar defrost-cycle as the first defrosting method, a defrost-cycle is provided as follows; the first evaporator 121 and the second evaporator 122 operate with the evaporation process to absorb the heat energy from the outdoor-air-flow as shown in FIG. 1A for 10 minute, and next the first evaporator 121 defrosts with the high speed cross reverse defrosting process as shown in FIG. 1D for 2 minute, and next the second evaporator 122 defrosts with the high speed cross reverse defrosting process as shown in FIG. 1E for 2 minute, and next the control system repeats the defrost-cycle until further change in the outdoor environment is detected.

The basic concept of the high speed cross reverse defrosting process is to transfer a controlled amount of the indoor air into the heat insulated space of the evaporator that is defrosting, and at the same time a controlled amount of the pressurized refrigerant will be distributed into the evaporator that is defrosting, the accumulated frost on said evaporator will melt by the heat generated from condensation process and the heat energy of the indoor air, therefore, the required time for the defrosting process will be greatly shortened, and the indoor air will be ventilated during this process; the other evaporator of the system will continue the evaporation process with the outdoor-air-flow, the main compressor and the main condenser will also continue their operations to generate the heat energy for the air-conditioning. The defrost-cycle of the high speed cross reverse defrosting process requires each evaporator to alternate its operation at a time interval, and the detailed control scheme is provide in FIG. 1D and FIG. 1E.

As shown in FIG. 1D, the first evaporator 121 is defrosting with the high speed cross reverse defrosting process; the first evaporator 121 will stop the evaporation process and disable the refrigerant passage from the main expansion valve 103 by shutting the first upper-flow valve 131 and first lower-flow valve 171. The cross reverse refrigerant circulation will be initiated by opening the first reverse-flow valve 151, providing a refrigerant passage from the main compressor 101 to the first evaporator 121, so that the pressurized refrigerant from the main compressor 101 will now be distributed to the main condenser 102 and the first evaporator 121; said pressurized refrigerant will condense in the first evaporator 121 to heat up and melt the accumulated ice on the first evaporator 121, and said refrigerant-flow of the first evaporator 121 will exit through the first expansion valve 141 and the first one-way valve 161 into the second evaporator 122; the first outdoor-air-intake valve 195 will be shut to stop the outdoor-air-flow of the first evaporator 121, the first venting fan 191 will stop or spin slowly to conserve the heat inside the heat insulated space of the first evaporator 121, thus creating a hot environment inside the heat insulated space of the first evaporator 121; the first evaporator 121 will now be defrosting with the heat energy of the condensation process and the indoor-air-flow; the second evaporator 122 will receive both the refrigerant-flow from the main expansion valve 103 and the refrigerant-flow from the first one-way valve 161; in other words, the main condenser 102 and the first evaporator 121 will be condensing refrigerant to generate heat energy for the air-conditioning and the high speed cross reverse defrosting process respectively, while the second evaporator 122 will be operating with the evaporation process by absorbing the heat from the outdoor-air-flow; the second venting fan 192 will be operating at full speed to provide a sufficient flow of the outdoor air for the evaporating process of the second evaporator 122.

As shown in FIG. 1E, the second evaporator 122 is defrosting with the high speed cross reverse defrosting process; the second evaporator 122 will stop the evaporation process and disable the refrigerant passage from the main expansion valve 103 by shutting the second upper-flow valve 132 and second lower-flow valve 172. The cross reverse refrigerant circulation will be initiated by opening the second reverse-flow valve 152, providing a refrigerant passage from the main compressor 101 to the second evaporator 122, so the pressurized refrigerant from the main compressor 101 will now be distributed to the main condenser 102 and the second evaporator 122; said pressurized refrigerant will condense in the second evaporator 122 to heat up and melt the accumulated ice on the first evaporator 121, and said refrigerant-flow of the second evaporator 122 will exit through the second expansion valve 142 and the second one-way valve 162 into the first evaporator 121; the second outdoor-air-intake valve 196 will be shut to stop the outdoor-air-flow into the heat insulated space of the second evaporator 122, the second venting fan 192 will stop or spin slowly to conserve the heat inside the heat insulated space of the second evaporator 122, thus creating a hot environment inside the heat insulated space of the second evaporator 122; the second evaporator 122 will now be defrosting with the heat energy of the condensation process and the indoor-air-flow; the first evaporator 121 will receive both the refrigerant-flow from the main expansion valve 103 and the refrigerant-flow from the second one-way valve 162; in other words, the main condenser 102 and the second evaporator 122 will be condensing refrigerant to generate the heat energy for the air-conditioning and the high speed cross reverse defrosting process respectively, while the first evaporator 121 will be operating with the evaporation process by absorbing the heat from the outdoor-air-flow; the first venting fan 191 will be operating at full speed to provide a sufficient flow of the outdoor air for the evaporating process of the first evaporator 121.

The first embodiment of the present invention can be further extended with additional evaporators. And the control system can adjust accordingly to the basic concept of the present invention; when one of the evaporators is frosted and requires to defrost with the second defrosting method, said frosted evaporator will block the refrigerant-flow from the main expansion valve and initiate the refrigerant-flow from the main compressor with its associated control valves, said frosted evaporator will initiate the condensation process with the pressurized refrigerant from the main compressor, and the heat insulated space of said frosted evaporator will block the flow of the outdoor air and admit a controlled amount of indoor air with its associated air-intake means, at the same time all other evaporators can continue the evaporation process to absorb heat energy from the outdoor-air-flow, the main compressor and the main condenser will continue their operation for the air-conditioning; the control system will also operate in a similar defrost-cycle, a defrost-cycle is as follows, all evaporators operate with the evaporation process for 10 minute, and next the first evaporator defrosts for 2 minute, next the second evaporator defrosts for 2 minute, and next the third evaporator defrosts for 2 minute, and next the fourth evaporator defrosts for 2 minute, and next the control system repeats the defrost-cycle or adjust its operation if further change in the outdoor temperature is detected.

For easier maintenance, most control valves can be combined into one single rotary valve or other multi-port control valve means. An alternative scheme of the control valve means is provided as follows, wherein the first reverse-flow valve 151 and the first upper-flow valve 131 are replaced with the first rotary upper-flow valve capable of same functions, the first lower-flow valve 171 and the first one-way valve 161 can be replaced with the first rotary lower-flow valve capable of same functions.

Many other construction schemes and control valve means are possible to perform the same task based on the principle of present invention and should be considered within the scope of the present invention.

Now referring to the second embodiment as shown in FIG. 2A to FIG. 2E for the multi-range cross-defrosting humidity control system constructed of the one-body defrost condenser.

The second embodiment also operate with a control system that changes the defrosting methods according to the outdoor temperature and humidity; when the outdoor temperature is in the range of 20 degree Celsius to 0 degree Celsius, the control system can apply the first defrosting method, which is also called as the cross-air defrosting process; when the outdoor temperature is in the range of 10 degree to negative 40 degree or lower, the control system can apply the second defrosting method, which is also called as the high speed cross-defrosting process; the threshold at which the control system switches between the cross-air defrosting process and the high speed cross-defrosting process can be adjust at any point between 10 degree Celsius to 0 degree Celsius.

Figure 2A:
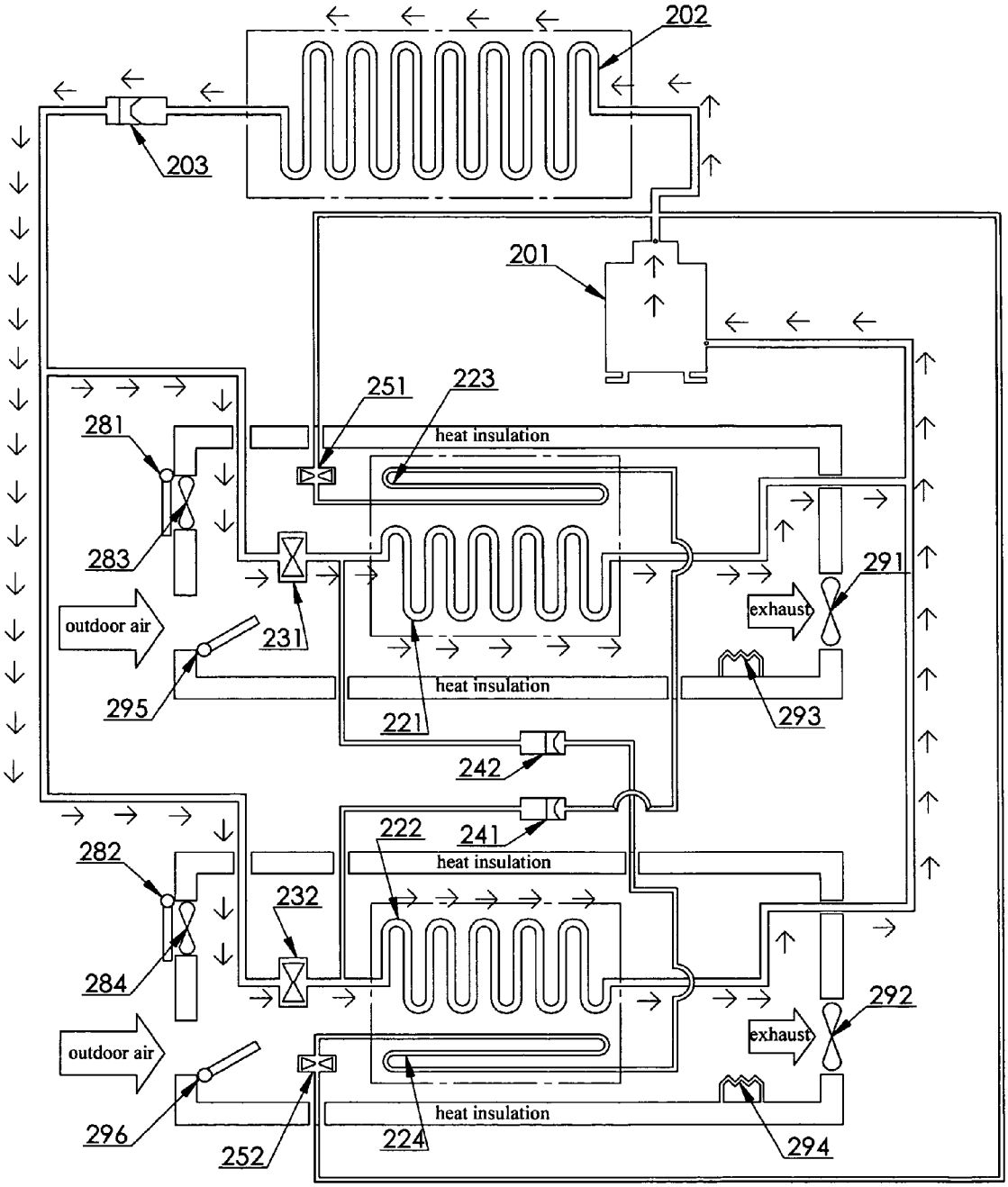
FIG. 2A to FIG. 2E shows the second embodiment of present invention, which is the multi-range cross-defrosting humidity control system constructed of the one-body defrost condenser; the control logic table is provided in Table. 2 as a reference to FIG. 2A to FIG. 2E.

The second embodiment as shown in FIG. 2A, the cross-defrosting humidity control system comprising the following basic components: main compressor 201, main condenser 202, first evaporator 221, second evaporator 222, main expansion valve 203, first upper-flow valve 231, second upper-flow valve 232, first defrost-flow valve 251, second defrost-flow valve 252, first expansion valve 241, second expansion valve 242, first defrost-condenser 223, second defrost-condenser 224, first venting fan 291, second venting fan 292, separate heat insulation for each evaporator, first indoor-air-intake fan 283, second indoor-air-intake fan 284, first outdoor-air-intake valve 295, second outdoor-air-intake valve 296, first indoor-air-intake valve 281, second indoor-air-intake valve 282, first temperature sensor 293, second temperature sensor 294, outdoor temperature sensor (not shown).

The first evaporator 221 and the first defrost-condenser 223 are constructed together to maximize the heat transfer rate between each other, therefore, the heat energy will be transfer from the first defrost-condenser 223 to the first evaporator 221 through the radiator fins they shared during the high speed cross defrosting process of the first evaporator 221.

The second evaporator 222 and the second defrost-condenser 224 are also constructed together in the same manner for maximizing the heat transfer rate between each other.

Now referring to FIG. 2A for the full capacity heating operation when both the first evaporator 221 and second evaporator 222 are operating with the evaporation process; the refrigerant-flow of the first evaporator 221 and the refrigerant-flow of the second evaporator 222 are enabled by opening the first upper-flow valve 231 and second upper-flow valve 232; the refrigerant circuits for the high speed cross-defrosting process are disabled by shutting the first defrost-flow valve 251 and the second defrost-flow valve 252; the heat insulated space of the first evaporator 221 and the second evaporator 222 will block the indoor-air-flow and admit the outdoor-air-flow for absorbing heat, the first indoor-air-intake fan 283 and the second indoor-air-intake fan 284 will be disabled to block the indoor-air-flow into the first evaporator 221 and the second evaporator 222, the first outdoor-air-intake valve 295 and the second outdoor-air-intake valve 296 will be open, the first venting fan 291 and the second venting fan 292 will be operating to draw the outdoor-air-flow into the heat insulated space of the first evaporator 221 and the heat insulated space of the second evaporator 222; the main compressor 201 and the main condenser 202 will be operating with the pressurization process and the condensation process respectively to provide the heat energy for the air-conditioning.

Figure 2B:
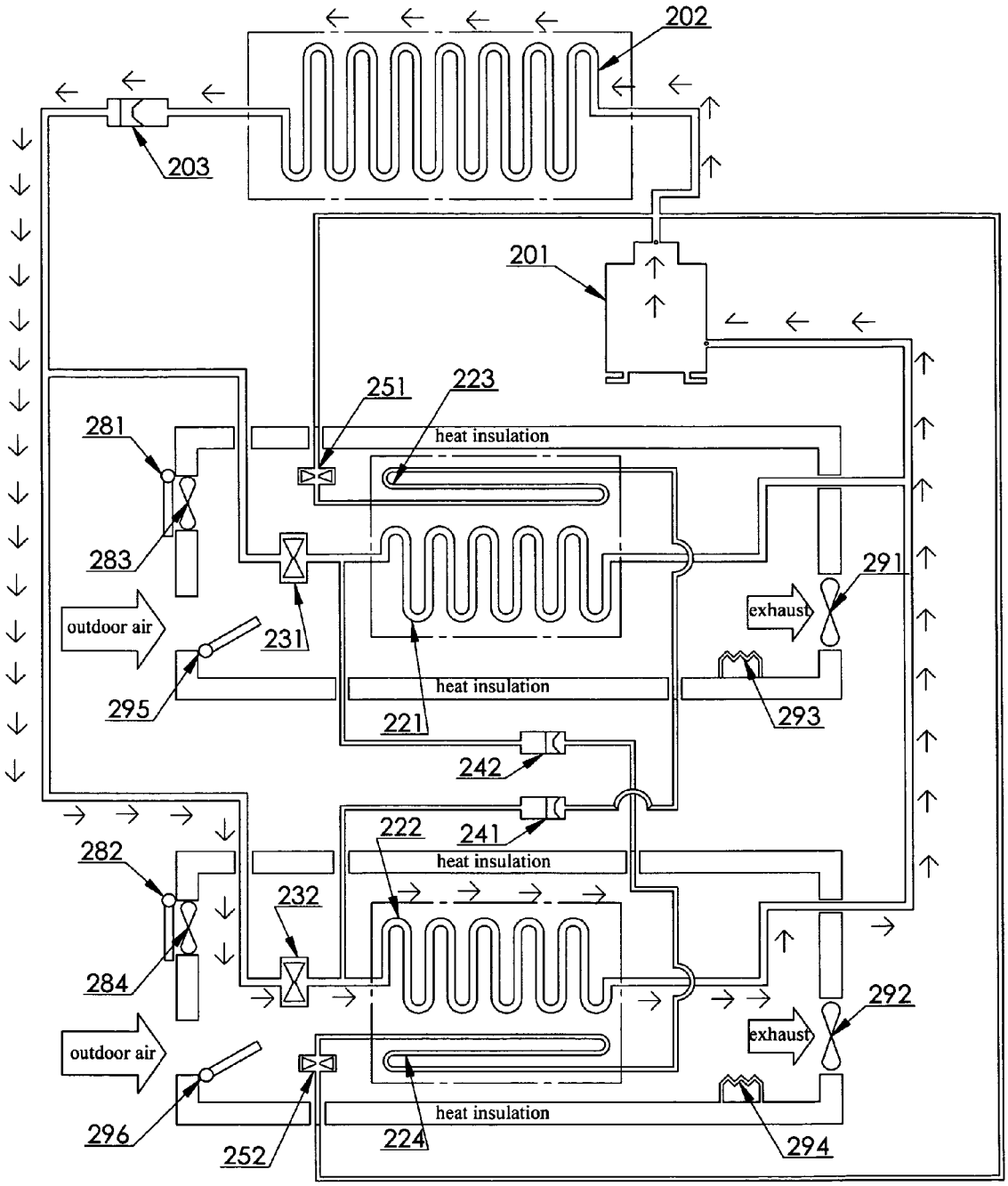
Figure 2C:
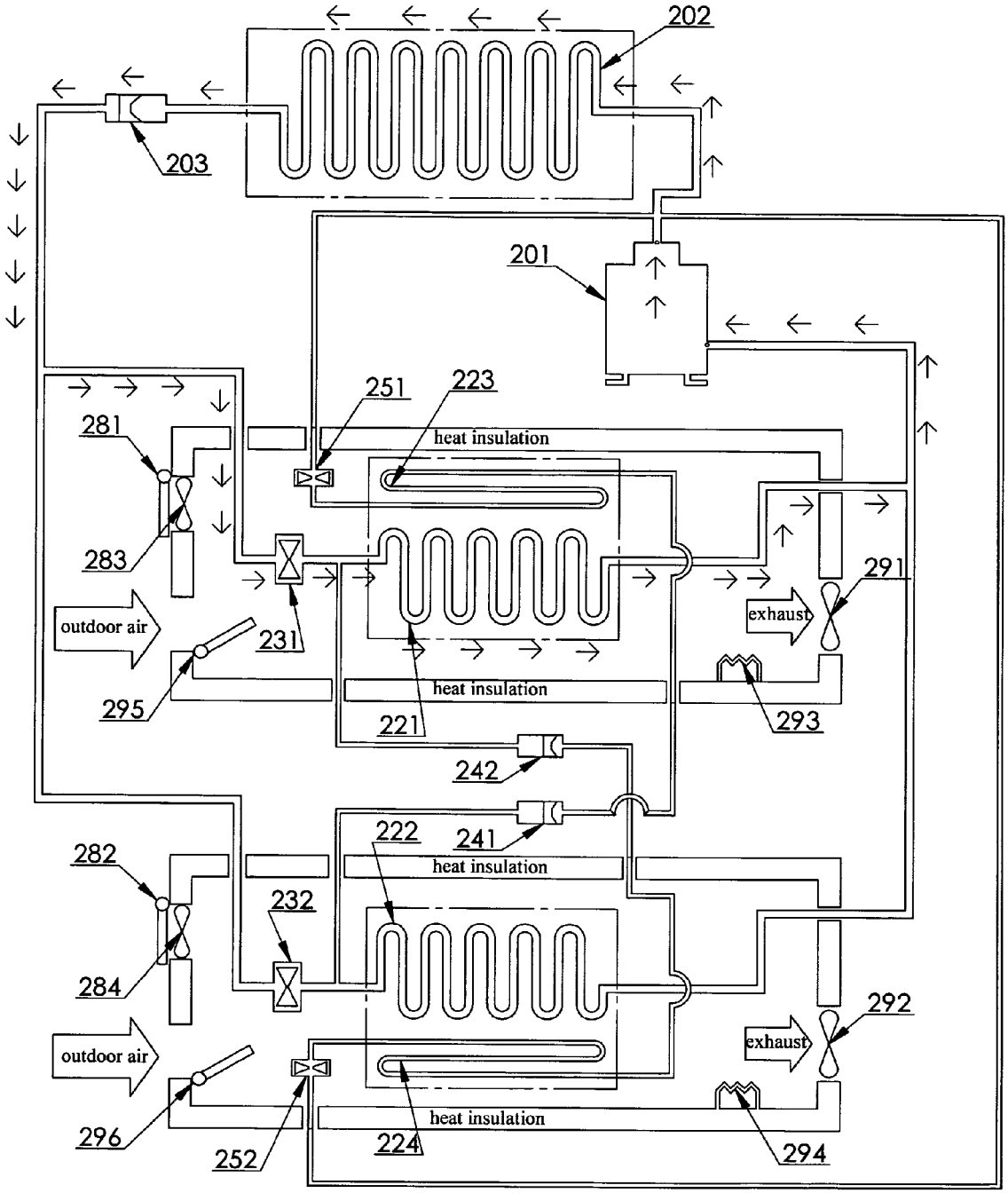

Now referring to FIG. 2B and FIG. 2C for the cross-air defrosting process of the second embodiment; the control system can employ said cross-air defrosting process when the outdoor temperature is between 20 degree Celsius and 0 degree Celsius; during the defrost-cycle of the cross-air defrosting process, the control system will defrost each evaporator with a defrost-cycle as follows; the first evaporator 221 defrosts with the cross-air defrosting process for 5 minute as shown in FIG. 2B, and next the second evaporator 222 defrosts with the cross-air defrosting process for 5 minute as shown in FIG. 2C, and next the first evaporator 221 and the second evaporator 222 will resume the evaporation process as shown in FIG. 2A or repeat the defrost-cycle if the condition required.

As shown in FIG. 2B, the first evaporator 221 is defrosting with the cross-air defrosting process; the refrigerant-flow of the first evaporator is disabled by shutting the first upper-flow valve 231, the outdoor-air-flow will be drawn into the heat insulated space of the first evaporator 221, and the frost on the first evaporator 221 will melt by the absorbing the heat energy of the outdoor-air-flow; the second evaporator 222 will operate with the evaporation process to provide the evaporated refrigerant to the main compressor 201; the main compressor 201 and the main condenser 202 will continue the pressurization process and the condensation process respectively for the air-conditioning; the refrigerant circuits for the high speed cross-defrosting process are disabled by shutting the first defrost-flow valve 251 and the second defrost-flow valve 252.

As shown in FIG. 2C, the second evaporator 222 is defrosting with the cross-air defrosting process; the refrigerant flow of the second evaporator 222 is disabled by shutting the second upper-flow valve 232, the outdoor-air-flow will be drawn into the heat insulated space of the second evaporator 222, and the frost on the second evaporator 222 will melt by the absorbing the heat energy of the outdoor-air-flow; the first evaporator 221 will operate with the evaporation process to provide the evaporated refrigerant to the main compressor 201; the main compressor 201 and the main condenser 202 will continue the pressurization process and the condensation process respectively for the air-conditioning; the refrigerant circuits for the high speed cross-defrosting process are disabled by shutting the first defrost-flow valve 251 and the second defrost-flow valve 252.

Figure 2D:
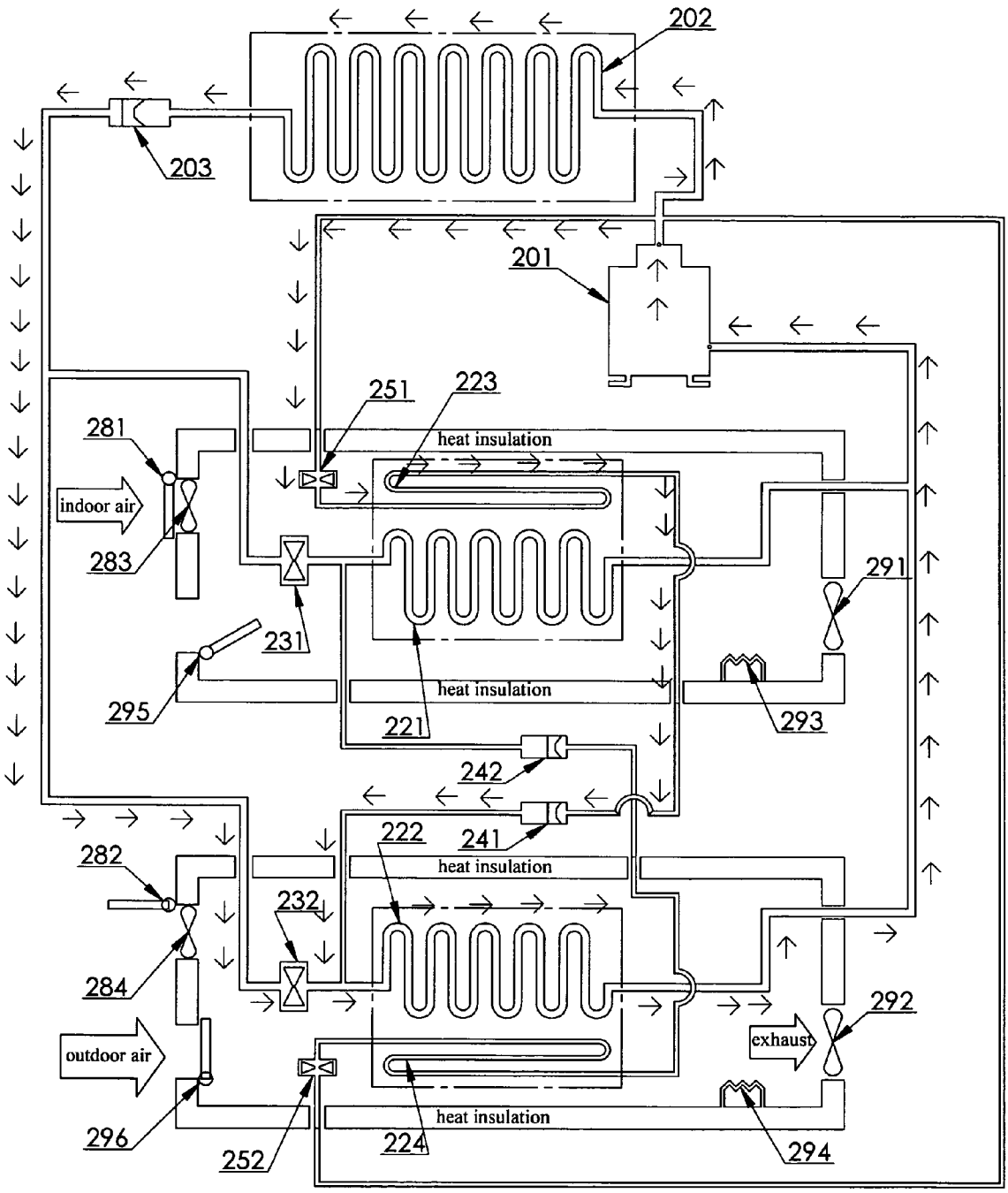
Figure 2E:
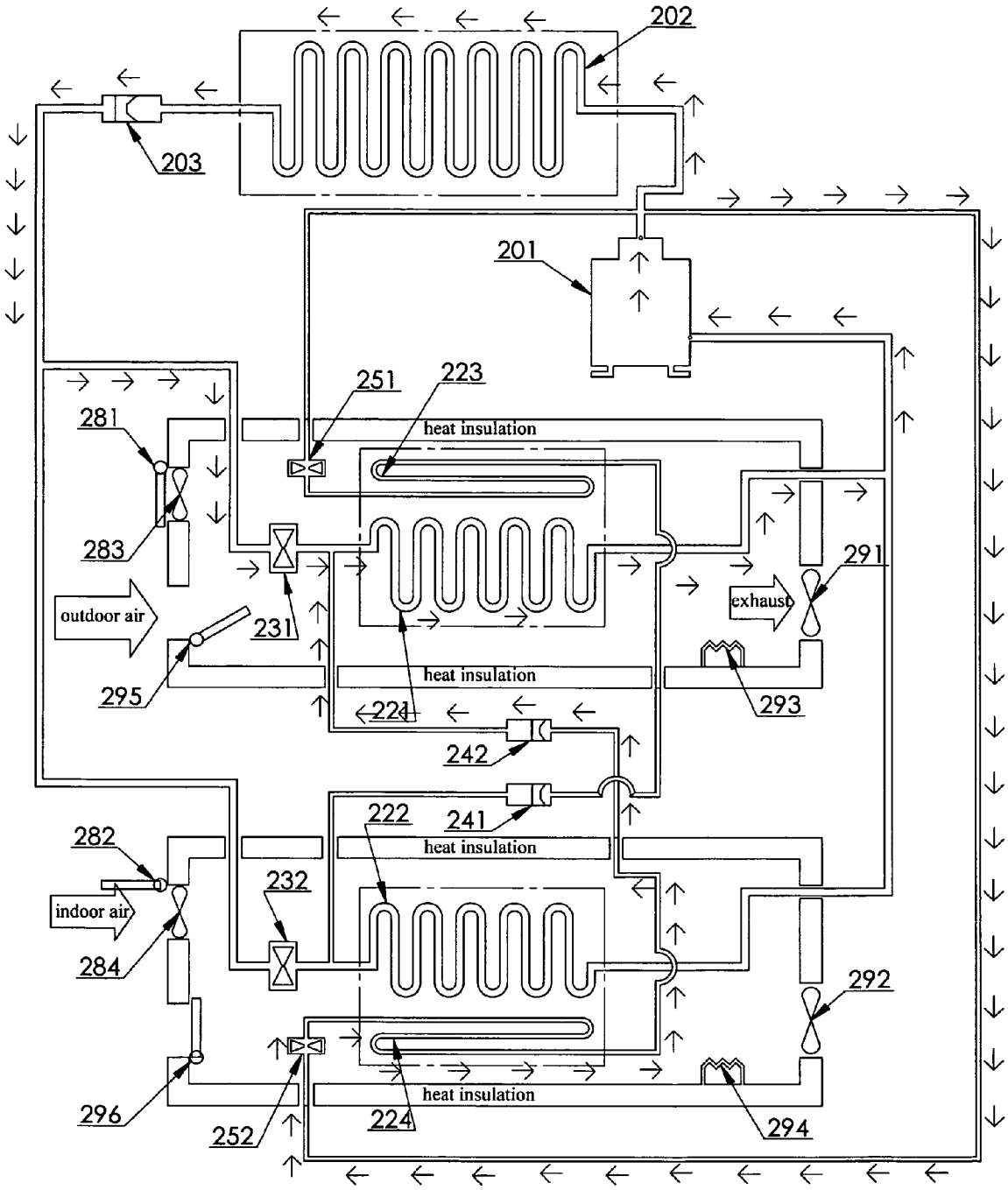

Now referring to FIG. 2D and FIG. 2E. When the outdoor temperature reaches the threshold for initiating the high speed cross defrosting process, the control system will operate with a defrost-cycle of the high speed cross defrosting process, a defrost-cycle is provided as follows; the first evaporator 221 and the second evaporator 222 operate with the evaporation process to absorb the heat energy from the outdoor-air-flow as shown in FIG. 2A for 10 minute, and next the first evaporator 221 defrosts with the high speed cross defrosting process as shown in FIG. 2D for 2 minute, and next the second evaporator 222 defrosts with the high speed cross defrosting process as shown in FIG. 2E for 2 minute, and next the system repeats the defrost-cycle until further change in the outdoor environment is detected.

The basic concept of the high speed cross defrosting process is to transfer a controlled amount of the indoor air into the heat insulated space of the evaporator that is defrosting, and at the same time a controlled amount of the pressurized refrigerant will be distributed into the defrost-condenser associated with the evaporator that is defrosting, the accumulated frost on said evaporator will melt by the heat current transferred from its associated defrost-condenser and the heat energy of the indoor air, therefore, the required time for the defrosting process will be greatly shortened, and the indoor air will be ventilated during this process; the other evaporator of the system will continue the evaporation process with the outdoor-air-flow, the main compressor and the main condenser will also continue their operation to generate the heat energy for the air-conditioning. The defrost-cycle of the high speed cross defrosting process requires each evaporator to alternate its operation at a time interval, and the detailed control scheme is provide in FIG. 2D and FIG. 2E.

As shown in FIG. 2D, the first evaporator 221 is defrosting with the high speed cross defrosting process; the first evaporator 221 will stop the evaporation process and disable the refrigerant passage from the main expansion valve 203 by shutting the first upper-flow valve 231; the first defrost-condenser 223 will be enabled by opening the first defrost-flow valve 251, providing a refrigerant passage from the main compressor 201 to the first defrost-condenser 223, so the pressurized refrigerant from the main compressor 201 will now be distributed to the main condenser 202 and the first defrost-condenser 223; said pressurized refrigerant will condense in the first defrost-condenser 223 to heat up and melt the accumulated frost on the first evaporator 221, and said refrigerant-flow of the first defrost-condenser 223 will exit through the first expansion valve 241 into the second evaporator 222; the first outdoor-air-intake valve 295 will be shut to stop the outdoor-air-flow of the first evaporator 221, the first venting fan 291 will stop or spin slowly to conserve the heat inside the heat insulated space of the first evaporator 221, thus creating a hot environment inside the heat insulated space of the first evaporator 221; the first evaporator 221 will now be defrosting with the heat energy of the condensation process of the first defrost-condenser 223 and the indoor-air-flow; the second evaporator 222 will receive the refrigerant-flow from the main expansion valve 103 and the refrigerant-flow from the first expansion valve 241; in other words, the main condenser 202 and the first defrost-condenser 223 will be condensing refrigerant to generate heat energy for the air-conditioning and the high speed cross defrosting process respectively, while the second evaporator 222 will be operating with the evaporation process by absorbing the heat from the outdoor-air-flow; the second venting fan 292 will be operating at full speed to provide a sufficient flow of the outdoor air for the evaporating process of the second evaporator 222; the second defrost-condenser 224 is disabled by shutting the second defrost-flow valve 252.

As shown in FIG. 2E, the second evaporator 222 is defrosting with the high speed cross defrosting process; the second evaporator 222 will stop the evaporation process and disable the refrigerant passage from the main expansion valve 203 by shutting the second upper-flow valve 232; the second defrost-condenser 224 will be enabled by opening the second defrost-flow valve 252, providing a refrigerant passage from the main compressor 201 to the second defrost-condenser 224, so the pressurized refrigerant from the main compressor 201 will now be distributed to the main condenser 202 and the second defrost-condenser 224; said pressurized refrigerant will condense in the second defrost-condenser 224 to heat up and melt the accumulated frost on the second evaporator 222, and said refrigerant-flow of the second defrost-condenser 224 will exit through the second expansion valve 242 into the first evaporator 221; the second outdoor-air-intake valve 296 will be shut to stop the outdoor-air-flow of the second evaporator 222, the second venting fan 292 will stop or spin slowly to conserve the heat inside the heat insulated space of the second evaporator 222, thus creating a hot environment inside the heat insulated space of the second evaporator 222; the second evaporator 222 will now be defrosting with the heat energy of the condensation process of the second defrost-condenser 224 and the indoor-air-flow; the first evaporator 221 will receive the refrigerant-flow from the main expansion valve 203 and the refrigerant-flow from the second expansion valve 242; in other words, the main condenser 202 and the second defrost-condenser 224 will be condensing refrigerant to generate heat energy for the air-conditioning and the high speed cross defrosting process respectively, while the first evaporator 221 will be operating with the evaporation process by absorbing the heat from the outdoor-air-flow; the first venting fan 291 will be operating at full speed to provide a sufficient flow of the outdoor air for the evaporating process of the first evaporator 221; the first defrost-condenser 223 is disabled by shutting the first defrost-flow valve 251.

The second embodiment of the present invention can be further extended with additional evaporators and additional defrost-condensers, and the control system can adjust accordingly to the basic concept of the present invention; when one of the evaporators is frosted and requires to defrost with the high speed cross defrosting process, said frosted evaporator will block the refrigerant passage from the main expansion valve with its associated control valves, and the defrost-condenser associated with said frosted evaporator will initiate the refrigerant-flow from the main compressor with its associated control valves, said defrost condenser will initiate the condensation process with the pressurized refrigerant from the main compressor, and the heat insulated space of said frosted evaporator will block the flow of the outdoor air and admit a controlled amount of indoor air with its associated air-intake means, at the same time all other evaporators can continue the evaporation process to absorb heat energy from the outdoor-air-flow, the main compressor and the main condenser will continue their operation for the air-conditioning; the control system will also operate in a defrost-cycle, wherein each evaporator will take turns to operate with the high speed cross defrosting process, a defrost cycle is as follows, all evaporators operate with the evaporation process for 10 minute, and next the first evaporator defrosts for 2 minute, next the second evaporator defrosts for 2 minute, and next the third evaporator defrosts for 2 minute, and next the fourth evaporator defrosts for 2 minute, and next the control system repeats the defrost-cycle or adjust its operation if further change in the outdoor temperature is detected.

The control system can further employ the sensor means for the progress of the defrosting process to detect if the evaporator has melted all the frost thereon, if all the frost has melted, the control system can be reset to the next step of the defrost-cycle; said sensor means can be a pressure or temperature sensor in the evaporator.

A special ventilation operation mode can also be implanted in the control system as an additional function, said operation mode is called as the forced-ventilation mode, wherein a controlled amount of the outdoor-air-flow and a controlled amount of the indoor-air-flow are admitted into the evaporators that are operating with the evaporation process, therefore the indoor air will be drawn out of the indoor space for the ventilation purpose, while the heat insulated space of each evaporator will have an air flow of higher temperature, thus ventilating the indoor air with a high energy recovery rate.

It should be understood that the threshold temperatures for initiating each stage of defrosting are different for each regions in the world, wherein the humidity and frosting condition are the main factor for selecting the appropriate threshold for each defrosting method and operation mode.

TABLE 1

Control Logics of First Embodiment

| Label | Component Name | All evaporators operating at full capacity | Cross-air defrost process of First evaporator | Cross-air defrost process of Second evaporator | Cross reverse defrost process of First evaporator | Cross reverse defrost process of Second evaporator |
|---|---|---|---|---|---|---|
| 102 | Main condenser | Condensation Process | Condensation Process | Condensation Process | Condensation Process | Condensation Process |
| 121 | First evaporator | Evaporation Process | Defrosting with Outdoor-air-flow | Evaporating Process | High speed cross reverse Defrosting | Evaporating Process |
| 122 | Second evaporator | Evaporating Process | Evaporating Process | Defrosting with Outdoor-air-flow | Evaporating Process | High speed cross reverse Defrosting |
| 151 | First reverse-flow valve | Closed | Closed | Closed | Open | Closed |
| 152 | Second reverse-flow valve | Closed | Closed | Closed | Closed | Open |
| 131 | First upper-flow valve | Open | Closed | Open | Closed | Open |
| 171 | First lower-flow valve | Open | Closed | Open | Closed | Open |
| 132 | Second upper-flow valve | Open | Open | Closed | Open | Closed |
| 172 | Second lower-flow valve | Open | Open | Closed | Open | Closed |
| 191 | First venting fan | Full speed | Full speed | Full speed | Decreasing speed | Full speed |
| 192 | Second venting fan | Full speed | Full speed | Full speed | Full speed | Decreasing speed |
| 183 | First indoor-air-intake fan | Disabled | Disabled | Disabled | Operating at a controlled speed | Disabled |
| 184 | Second indoor-air-intake fan | Disabled | Disabled | Disabled | Disabled | Operating at a controlled speed |

TABLE 2

Control Logics of Second Embodiment

| Label | Component Name | All evaporators operating at full capacity | Cross-air defrost process of First evaporator | Cross-air defrost process of Second evaporator | Cross reverse defrost process of First evaporator | Cross reverse defrost process of Second evaporator |
|---|---|---|---|---|---|---|
| 202 | Main condenser | Condensation Process | Condensation Process | Condensation Process | Condensation Process | Condensation Process |
| 221 | First evaporator | Evaporation Process | Defrosting with Outdoor-air-flow | Evaporating Process | High speed Cross-Defrosting | Evaporating Process |
| 222 | Second evaporator | Evaporating Process | Evaporating Process | Defrosting with Outdoor-air-flow | Evaporating Process | High speed Cross-Defrosting |
| 223 | First defrost-condenser | Disabled | Disabled | Disabled | Condensation Process | Disabled |
| 224 | Second defrost-condenser | Disabled | Disabled | Disabled | Disabled | Condensation Process |
| 251 | First defrost-flow valve | Closed | Closed | Closed | Open | Closed |
| 252 | Second defrost-flow valve | Closed | Closed | Closed | Closed | Open |
| 231 | First upper-flow valve | Open | Closed | Open | Closed | Open |
| 232 | Second upper-flow valve | Open | Open | Closed | Open | Closed |
| 291 | First venting fan | Full speed | Full speed | Full speed | Decreasing speed | Full speed |
| 292 | Second venting fan | Full speed | Full speed | Full speed | Full speed | Decreasing speed |
| 283 | First indoor-air-intake fan | Disabled | Disabled | Disabled | Operating at a controlled speed | Disabled |
| 284 | Second indoor-air-intake fan | Disabled | Disabled | Disabled | Disabled | Operating at a controlled speed |

The invention claimed is:

1. A multi-range cross-reverse air-conditioning system comprising:

a) a main refrigeration circuit for the air-conditioning, said main refrigeration circuit consisting a main compressor for pressurizing refrigerant, a main condenser for condensing refrigerant and releasing heat, at least two evaporators for evaporating refrigerant and absorbing heat energy, a main expansion valve for regulating the refrigerant pressure difference between said main condenser and said two evaporators;

b) each of said two evaporators including flow control means for disabling the evaporation process individually by blocking the refrigerant passage from said main expansion valve;

c) each of said two evaporators including flow control means for providing a refrigerant passage from said main compressor to said two evaporators individually;

d) each of said two evaporators including a heat insulated space, and said heat insulated space including individual outdoor-air-intake means and indoor-air-intake means;

e) a control system for selecting defrosting methods and controlling all said flow control means and outdoor-air-intake means and indoor-air-intake means;

f) during the full capacity heating operation, all said evaporators will operate with the evaporation process by receiving the refrigerant-flow from said main expansion valve, while all refrigerant passages from said main compressor to each evaporator will be blocked to disable the refrigerant-flow associated with the high speed cross-reverse defrosting process, a controlled flow of outdoor air is admitted into the heat insulated space of each evaporator by its associated outdoor-air-intake means, meanwhile all said indoor-air-intake means are disabled to block the air passage between the indoor space and the heat insulated space of each evaporator;

g) said multi-range cross-reverse air-conditioning system is capable of defrosting each evaporator by a defrost-cycle of the high speed cross-reverse defrosting process, wherein each of said evaporator will alternately operate with the high speed cross-reverse defrosting process and the refrigerant evaporation process;

h) during the high speed cross-reverse defrosting process of each evaporator, said outdoor-air-intake means will stop inhaling outdoor air into the heat insulated space of the evaporator that is defrosting, a controlled flow of indoor air will be transferred into the heat insulated space of the evaporator that is defrosting, and at the same time a controlled amount of the pressurized refrigerant will be distributed into the evaporator that is defrosting, the accumulated frost on said evaporator will be melted by the heat generated from the condensation process therein and the heat energy of the indoor air, therefore the indoor air will be ventilated during this process, the other evaporator will continue the evaporation process with a flow of outdoor air, the main compressor and the main condenser will continue their operation to generate the heat energy for the air-conditioning;

i) during the high speed cross-reverse defrosting process of each evaporator, the evaporator that is defrosting with the high speed cross-reverse defrosting process will receive a flow of pressurized refrigerant from said main compressor, and said flow of pressurized refrigerant will condense in said defrosting evaporator and exit via its associated pressure regulating means into the other evaporator that is operating with the evaporation process.

2. A multi-range cross-reverse air-conditioning system as defined in claim 1, which further comprises additional evaporators; wherein each of said additional evaporators includes individual flow control means for initiating the high speed cross-reverse defrosting process; during the defrost-cycle of the high speed cross-reverse defrosting process, the evaporator that is defrosting will receive a portion of the pressurized refrigerant from the main compressor, said evaporator will defrost with the heat energy of the indoor-air-flow and the condensation process therein, meanwhile the other evaporators will continue the evaporation process with a flow of outdoor air, the main compressor and the main condenser will continue their operation to generate the heat energy for the air-conditioning.

3. A multi-range cross-reverse air-conditioning system as defined in claim 1, wherein; each evaporator can further comprise sensor means for detecting the progress of the high speed cross-reverse defrosting process; and said control system can adjust the defrost-cycle accordingly for optimum heating efficiency.

4. A multi-range cross-reverse air-conditioning system as defined in claim 1; said control system can further comprise a forced-ventilation mode, wherein a controlled flow of the outdoor-air and a controlled flow of the indoor-air are admitted into the heat insulated space of the evaporators that are operating with the evaporation process, therefore the indoor air will be drawn out of the indoor space for the ventilation purpose, while the heat insulated space of each evaporator will have an air flow of higher temperature, thus ventilating the indoor air with a high energy recovery rate.

5. A multi-range defrost-condenser type air-conditioning system comprising:

a) a main refrigeration circuit for the air-conditioning, said main refrigeration circuit consisting a main compressor for pressurizing refrigerant, a main condenser for condensing refrigerant and releasing heat, at least two evaporators for evaporating refrigerant and absorbing heat energy, a main expansion valve for regulating the refrigerant pressure difference between said main condenser and said two evaporators;

b) each of said two evaporators including flow control means for disabling the evaporation process individually by blocking the refrigerant passage from said main expansion valve;

c) each of said two evaporators including a defrost-condenser for transferring the heat energy during the high speed cross defrosting process; each defrost-condenser includes flow control means to receive a flow of pressurized refrigerant from the main compressor during the high speed cross defrosting process of its associated evaporator;

d) each of said two evaporators including a heat insulated space, and said heat insulated space including individual outdoor-air-intake means and indoor-air-intake means;

e) a control system for selecting defrosting methods and controlling all said flow control means and outdoor-air-intake means and indoor-air-intake means;

f) said multi-range defrost-condenser type air-conditioning system is capable of defrosting each evaporator by a defrost-cycle of the high speed cross-defrosting process, wherein each of said evaporator will alternately operate with the high speed cross defrosting process and the refrigerant evaporation process;

g) during the high speed cross defrosting process of each evaporator, said outdoor-air-intake means will stop inhaling outdoor air into the heat insulated space of the evaporator that is defrosting, a controlled flow of indoor air will be transferred into the heat insulated space of the evaporator that is defrosting, a controlled flow of the pressurized refrigerant from the main compressor will be distributed to the defrost condenser associated with the evaporator that is defrosting, the accumulated frost on said evaporator will melt by the heat generated from the condensation process therein and the heat energy of the indoor air, meanwhile the other evaporator will continue the evaporation process with a flow of outdoor air provided by said outdoor-air-intake means, the main compressor and the main condenser will continue their operation to generate the heat energy for the air-conditioning.

6. A multi-range defrost-condenser type air-conditioning system as defined in claim 5, which further comprises additional evaporators; wherein each of said additional evaporators includes individual flow control means and a defrost-condenser for initiating the high speed cross defrosting process; during the defrost-cycle of the high speed cross-defrosting process, the defrost-condenser associated with the evaporator that is defrosting will receive a portion of the pressurized refrigerant from the main compressor, said evaporator will defrost with the heat energy of the indoor-air-flow and the condensation process of its associated defrost-condenser, meanwhile the other evaporators will continue the evaporation process with a flow of outdoor air, the main compressor and the main condenser will continue their operation to generate the heat energy for the air-conditioning.

7. A multi-range defrost-condenser type air-conditioning system as defined in claim 5, wherein; each defrost-condenser has pressure regulating means and a refrigerant passage to another evaporator; during the high speed cross defrosting process, the defrost-condenser associated with the defrosting evaporator will transfer the refrigerant therein to another evaporator through said pressure regulating means and said refrigerant passage.

8. A multi-range defrost-condenser type air-conditioning system as defined in claim 5, wherein; each defrost-condenser and evaporator can further comprise individual sensor means for detecting the progress of the defrosting process; and said control system can adjust the defrost-cycle accordingly for optimum heating efficiency.

9. A multi-range cross-reverse air-conditioning system comprising:

a) a refrigeration circuit comprising of four sections, which are a refrigerant-compressing section, a refrigerant-condensing section, a refrigerant-evaporating section, and a cross-reverse section; said refrigerant-compressing section provides a flow of pressurized-refrigerant to said refrigerant-condensing section and said cross-reverse section; said refrigerant-condensing section will condense said flow of pressurized-refrigerant therein, and release the heat energy for air-conditioning; said refrigerant-condensing section will provide a flow of refrigerant to said refrigerant-evaporating section; said refrigerant-evaporating section absorbs heat from the outdoor environment and evaporates said flow of refrigerant therein, and then produces a flow of evaporated-refrigerant into said refrigerant-compressing section;

b) said refrigerant-compressing section comprises at least one compressor (101);

c) said refrigerant-condensing section comprises at least one main condenser (102);

d) said refrigerant-evaporating section comprises at least two evaporator units, which are first-evaporator (121) and second-evaporator (122); each of said evaporator units has an individual heat insulated space and outdoor-air-intake means and indoor-air-intake means;

e) flow control means for independently controlling the refrigerant passage from said refrigerant-condensing section to said first-evaporator (121);

f) flow control means for independently controlling the refrigerant passage from said refrigerant-condensing section to said second-evaporator (122);

g) said cross-reverse section comprises a controlled refrigerant passage to each of said evaporator in said refrigerant-evaporating section; a first reverse-flow valve (151) for distributing a flow of pressurized refrigerant to said first evaporator (121) during the high speed cross-reverse defrosting process of said first evaporator (121); a second reverse-flow valve (152) for distributing a flow of pressurized refrigerant to said second evaporator (122) during the high speed cross-reverse defrosting process of said second evaporator (122);

i) a control system for commencing a defrost-cycle of the high speed cross-reverse defrosting process by controlling said flow control means and outdoor-air-intake means and indoor-air-intake means;

j) said multi-range cross-reverse air-conditioning system is capable of defrosting each evaporator by a defrost-cycle of the high speed cross-reverse defrosting process, wherein each of said evaporator will alternately operate with the high speed cross-reverse defrosting process and the refrigerant evaporation process.

10. A multi-range cross-reverse air-conditioning system as defined in claim 9, wherein; during the full capacity heating operation, all said evaporators will operate with the evaporation process; said cross-reverse section will be disabled by shutting said first reverse-flow valve (151) and said second reverse-flow valve (152); a controlled flow of outdoor air is admitted into the heat insulated space of said first evaporator (121) and the heat insulated space of said second evaporator (122) by their associated outdoor-air-intake means; all said indoor-air-intake means will block the air passage between the indoor space and the heat insulated space of each evaporator.

11. A multi-range cross-reverse air-conditioning system as defined in claim 9, wherein; during the high speed cross-reverse defrosting process of said first evaporator (121), the refrigerant passage of said first evaporator (121) will be isolated from said refrigerant-evaporating section by its associated flow control means, and first reverse-flow valve (151) will open to provide a flow of pressurized refrigerant into said first evaporator (121), and said heat insulated space of first evaporator (121) will be filled with the indoor air by its associated indoor-air-intake means, therefore, the accumulated frost on said first evaporator (121) will melt by the heat energy of the indoor air and the condensation process therein, meanwhile said second evaporator (122) will operate with the evaporation process by absorbing the heat of the outdoor-air-flow, said main compressor (101) and said main condenser (102) will continue operation for the air-conditioning.

12. A multi-range cross-reverse air-conditioning system as defined in claim 9, wherein; during the high speed cross-reverse defrosting process of said second evaporator (122), the refrigerant passage of said second evaporator (122) will be isolated from said refrigerant-evaporating section by its associated flow control means, and said second reverse-flow valve (152) will open to provide a flow of pressurized refrigerant into said second evaporator (122), and said heat insulated space of second evaporator (122) will be filled with the indoor air by its associated indoor-air-intake means, therefore, the accumulated frost on said second evaporator (122) will melt by the heat energy of the indoor air and the condensation process therein, meanwhile said first evaporator (121) will operate with the evaporation process by absorbing the heat of the outdoor-air-flow, said main compressor (101) and said main condenser (102) will continue operation for the air-conditioning.

13. A multi-range cross-reverse air-conditioning system as defined in claim 9, which can further comprise additional evaporators; wherein each of said additional evaporators includes individual flow control means and reverse-flow valve and indoor-air-intake means and outdoor-air-intake means for initiating the high speed cross-reverse defrosting process.

14. A multi-range defrost-condenser type air-conditioning system comprising:

a) a refrigeration circuit comprising of four sections, which are a refrigerant-compressing section, a refrigerant-condensing section, a refrigerant-evaporating section, and a cross-defrosting section; said refrigerant-compressing section provides a flow of pressurized-refrigerant to said refrigerant-condensing section and said cross-defrosting section; said refrigerant-condensing section will condense said flow of pressurized-refrigerant therein, and release the heat energy for air-conditioning; said refrigerant-condensing section provides a flow of refrigerant to said refrigerant-evaporating section; said refrigerant-evaporating section absorbs heat from the outdoor environment and evaporates said flow of refrigerant therein, and then produces a flow of evaporated-refrigerant into said refrigerant-compressing section;

b) said refrigerant-compressing section comprises at least one compressor (201);

c) said refrigerant-condensing section comprises at least one main condenser (202);

d) said refrigerant-evaporating section comprises at least two evaporator units, which are first-evaporator (221) and second-evaporator (222); each of said evaporator units has individual heat insulation and outdoor-air-intake means and indoor-air-intake means;

e) flow control means for independently controlling the refrigerant passage from said refrigerant-condensing section to said first-evaporator (221);

f) flow control means for independently controlling the refrigerant passage from said refrigerant-condensing section to said second-evaporator (222);

g) said cross-defrosting section comprises one defrost-condenser for each evaporator of said refrigerant-evaporating section; a first defrost-condenser (223) for complementing with said first-evaporator, a second defrost-condenser (224) for complementing with said second-evaporator (222);

h) a first defrost-flow valve (251) for controlling the flow rate of pressurized-refrigerant from said refrigerant-compressing section into said first defrost-condenser (223);

i) a second defrost-flow valve (252) for controlling the flow rate of pressurized-refrigerant from said refrigerant-compressing section into said second defrost-condenser (224);

j) a control system for commencing a defrost-cycle of the high speed cross-defrosting process by controlling said flow control means and outdoor-air-intake means and indoor-air-intake means;

k) said multi-range defrost-condenser type air-conditioning system is capable of defrosting each evaporator by a defrost-cycle of the high speed cross-defrosting process, wherein each of said evaporator will alternately operate with the high speed cross-defrosting process and the refrigerant evaporation process.

15. A multi-range defrost condenser type air-conditioning system as defined in claim 14, wherein; during the full capacity heating operation, all said evaporators will operate with the evaporation process; said cross-defrosting section will be disabled by shutting said first defrost-flow valve (251) and said second defrost-flow valve (252); a controlled flow of outdoor air is admitted into the heat insulated space of said first evaporator (221) and the heat insulated space of said second evaporator (222); all said indoor-air-intake means will block the air passages between the indoor space and the heat insulated space of each evaporator.

16. A multi-range defrost condenser type air-conditioning system as defined in claim 14, wherein; during the high speed cross-defrosting process of said first evaporator (221), said first evaporator (221) will stop the evaporation process therein by blocking the refrigerant passage from said main expansion valve (203); said first defrost-condenser (223) will initiate a flow of pressurized refrigerant with said first defrost-flow valve (251); said heat insulated space of first evaporator (221) will be filled with the indoor air by its associated indoor-air-intake means, therefore, the accumulated frost on said first evaporator (221) will melt by the heat energy of the indoor air and the heat energy conducted from said first defrost-condenser (223); meanwhile said second evaporator (222) will operate with the evaporation process by absorbing the heat of the outdoor-air-flow, said main compressor (201) and said main condenser (202) will continue operation for the air-conditioning.

17. A multi-range defrost condenser type air-conditioning system as defined in claim 14, wherein; during the high speed cross-defrosting process of said second evaporator (222), said second evaporator (222) will stop the evaporation process therein by blocking the refrigerant passage from said main expansion valve (203); said second defrost-condenser (224) will initiate a flow of pressurized refrigerant with said second defrost-flow valve (251); said heat insulated space of second evaporator (222) will be filled with the indoor air by its associated indoor-air-intake means, therefore, the accumulated frost on said second evaporator (222) will melt by the heat energy of the indoor air and the heat energy conducted from said second defrost-condenser (224); meanwhile said first evaporator (221) will operate with the evaporation process by absorbing the heat of the outdoor-air-flow, said main compressor (201) and said main condenser (202) will continue operation for the air-conditioning.

18. A multi-range defrost condenser type air-conditioning system as defined in claim 14, which can further comprises additional evaporators; wherein each of said additional evaporators includes individual flow control means and defrost-flow valve and indoor-air-intake means and outdoor-air-intake means for initiating the high speed cross-defrosting process.

19. A multi-range defrost condenser type air-conditioning system as defined in claim 14, wherein; said control system can employ a combination of the high speed cross-defrosting process and the cross-air defrosting process to maximize the heating efficiency of the air-conditioning.

20. A multi-range cross-reverse air-conditioning system as defined in claim 9, wherein; said control system can employ a combination of the high speed cross-reverse defrosting process and the cross-air defrosting process to maximize the heating efficiency of the air-conditioning.

* * * * *